US008308905B2

(12) United States Patent
Kaira

(10) Patent No.: US 8,308,905 B2
(45) Date of Patent: Nov. 13, 2012

(54) PROCESS FOR INCREASING BULK OF A FIBER PRODUCT, FIBER PRODUCT AND USE THEREOF

(75) Inventor: Mikko Juhani Kaira, Helsinki (FI)

(73) Assignee: Fibertus Oy, Espoo (FI)

( * ) Notice: Subject to any disclaimer, the term of this patent is extended or adjusted under 35 U.S.C. 154(b) by 238 days.

(21) Appl. No.: 12/373,209

(22) PCT Filed: Jul. 10, 2007

(86) PCT No.: PCT/FI2007/050422

§ 371 (c)(1),
(2), (4) Date: Sep. 9, 2009

(87) PCT Pub. No.: WO2008/006943

PCT Pub. Date: Jan. 17, 2008

(65) Prior Publication Data

US 2010/0006246 A1 Jan. 14, 2010

(30) Foreign Application Priority Data

Jul. 10, 2006 (FI) ..... 20060670

(51) Int. Cl.
*D21H 11/16* (2006.01)
*D21H 17/70* (2006.01)
*D21H 17/66* (2006.01)

(52) U.S. Cl. ..... 162/181.2; 162/181.1; 162/183

(58) Field of Classification Search ..... 162/181.4, 162/181.1, 181.2, 183
See application file for complete search history.

(56) References Cited

U.S. PATENT DOCUMENTS

| | | | | |
|---|---|---|---|---|
| 1,976,745 | A * | 10/1934 | Rafton | 162/181.3 |
| 2,810,644 | A | 10/1957 | Shearer | |
| 3,269,891 | A * | 8/1966 | Reynolds et al. | 162/169 |
| 4,606,264 | A * | 8/1986 | Agronin et al. | 100/38 |
| 5,904,808 | A * | 5/1999 | Gelman et al. | 162/7 |
| 6,623,599 | B1 | 9/2003 | Laurila-Lumme et al. | |
| 7,998,313 | B2 * | 8/2011 | Kokko | 162/157.1 |
| 2006/0104894 | A1 | 5/2006 | Daoud et al. | |
| 2006/0131362 | A1 | 6/2006 | Bergenudd et al. | |

FOREIGN PATENT DOCUMENTS

| | | | |
|---|---|---|---|
| CN | 1635213 | A | 7/2006 |
| EP | 0 791 685 | A2 | 8/1997 |
| FI | 100670 | B | 1/1998 |
| FI | 103520 | B | 7/1999 |
| WO | WO 99/45202 | | 9/1999 |

OTHER PUBLICATIONS

Smook, Handbook for Pulp and Paper Technologists, 1992, Angus Wilde Publications, 2nd edition, chapter 9.*
Calcium Sulfate dihyrate data page [downloaded online from www.guidechem.com], downloaded on May 26, 2011.*

* cited by examiner

*Primary Examiner* — Anthony Calandra
(74) *Attorney, Agent, or Firm* — Merchant & Gould P.C.

(57) ABSTRACT

The invention relates to a process for increasing bulk of a fiber product, in which process a fiber pulp, and further a fiber product, is formed. In accordance with the invention, in a first step a carbonate compound is added to the fiber pulp as a basic component, and in a second step acid is added as an acidic component, in order to form salt, to provide the formation of small-bubbled gas, and to increase the bulk, and the fiber pulp is dehydrated. The invention also relates to a corresponding fiber product and to the use thereof.

8 Claims, No Drawings

PROCESS FOR INCREASING BULK OF A FIBER PRODUCT, FIBER PRODUCT AND USE THEREOF

This application is a National Stage Application of PCT/FI2007/050422, filed 10 Jul. 2007, which claims benefit of Serial No. 20060670, filed 10 Jul. 2006 in Finland and which applications are incorporated herein by reference. To the extent appropriate, a claim of priority is made to each of the above disclosed applications.

FIELD OF THE INVENTION

The invention relates to a process for increasing bulk of a fiber product and to a fiber product with increased bulk.

BACKGROUND OF THE INVENTION

Known from prior art are different plate products made from paperboard, for example for decorating purposes. The problem with them has been their relatively high grammage. A thicker paperboard product, for example a paperboard sheet which is 2 cm thick, has relatively high grammage, and is thereby difficult to handle and to secure to the desired destination.

As is well known, the increase of bulk in a paper product, such as paper or paperboard, has been studied in the field of paper and paperboard manufacture. However, any technical breakthrough for increasing the bulk has not been found.

Bulk is the inverse of density. For paper and paperboard, the desired properties usually comprise low density, i.e. high bulk, the other critical properties being sufficient.

OBJECTIVE OF THE INVENTION

The objective of the invention is to eliminate the drawbacks referred to above. One specific objective of the invention is to disclose a novel process for increasing the bulk of a paper or a paperboard product, and a novel fiber product, which has a higher bulk and better strength properties with respect to the pulp used than the products of the prior art.

SUMMARY OF THE INVENTION

The process and the product in accordance with the invention are characterized by what has been presented in the claims.

The invention is based on a process for increasing the bulk of a fiber product, in which process a fiber pulp is formed, which pulp comprises fibers, and the desired fiber product is then formed of the fiber pulp. In accordance with the invention, in a first step a carbonate compound is added to the fiber pulp as a basic component, and in a second step acid is added as an acidic component in order to form salt, to provide a rapid formation of homogenous, small-bubbled gas and to increase the bulk of the fiber product, and the fiber pulp is dehydrated. In this way, the density of the fiber product becomes efficiently reduced.

The invention is also based on a fiber product formed of fibrous pulp. In accordance with the invention, the fiber pulp has first been modified by the basic carbonate compound and then by the acidic acid in order to form salt, to provide the formation of homogenous, small-bubbled gas, and to increase the bulk of the fiber product, and the fiber pulp has been dehydrated.

The invention is specifically premised on the idea that the bulk of traditional fiber products, such as paper products and paperboard products, can be increased. Preferably, the alternate adding of certain bases and acidic components produces a strong and rapid reaction, resulting in the formation of gas, such as carbon dioxide, and salt, and thereby in the release of the gas into the fiber pulp and in the precipitation of salts with fibers. The small gas bubbles adhere to the fibers, increasing the pulp volume. Preferably, no additional carbon dioxide or other gas is added externally to the fiber pulp in the process in accordance with the invention.

In this context, fiber pulp stands for any pulp formed of fibers, for example wood or vegetable fibers, and known per se, such as chemical pulp, mechanical pulp or recycled pulp. In addition to this, fiber pulp in this context stands for the fiber mixture used for making the web, and the fiber mixture contained in the formed web.

In this context, fiber product stands for any fiber product, such as a web for making paper or paperboard, a plate product or the like.

In one embodiment of the invention, the carbonate is selected from the group comprising sodium carbonate, sodium bicarbonate, and calcium carbonate. In an alternative embodiment, any suitable carbonate or other basic component can be used.

In one embodiment of the invention, the acid is selected from the group comprising acetic acid and sulfuric acid. For example, the salts formed by reaction between sulfuric acid and calcium carbonate have poor water-solubility. As a result, the product shall comprise special water resistance properties. In an alternative embodiment, any suitable acid or other acidic component can be used.

The selected acid-base pair provides a specific salt or salts. For example, the use of calcium carbonate and acetic acid produces calcium acetate.

In one embodiment of the invention, the fiber pulp is dehydrated before adding the basic and acidic components.

In one embodiment of the invention, the fiber pulp is dehydrated after the salt and gas formation. In one embodiment, the fiber pulp is dried, for example by means of vaporizing by heat or vaporizing by electromagnetic energy. This provides a hard fiber product with high bulk. The salts then concentrate in the drying fibers. In one embodiment, the fiber pulp is briefly heated to the melting point of salt, and then cooled back. During heating, the salts melt, and as the fiber pulp cools down, they resolidify. The solidified salt completes the hardening of the fiber pulp structure.

In one preferred embodiment, the fiber pulp is dehydrated both before adding the basic and acidic components and after the salt and gas formation.

In one embodiment, the hardness of the fiber pulp structure can be increased by adding starch to the fiber pulp with the basic component.

In one embodiment, the basic component is added to the fiber pulp in powder form. In one embodiment, the acidic component is added to the fiber pulp in the liquid state.

In one embodiment of the process, the acidic component is added to the fiber pulp before making the web, or during the making of the web, or to the fiber pulp contained in the formed web.

In one embodiment, the fiber product is directed to further processing, for example into paper, paperboard, plate products or the like, in manners known per se in the field.

In one embodiment, different additives, for example strength increasing agents, can be added to the fiber pulp.

The fiber product can be processed further or treated in the desired manner, for example coated, impregnated etc. Thanks to its lightness and strength, the fiber product is suitable for use in very different applications.

In accordance with the invention, the density of the fiber product can be reduced even up to a fifth as compared to the products of the prior art. In one embodiment, the density of the fiber product is 100-200 kg/m$^3$. Correspondingly, the bulk of the fiber product can be manifold increased, for example quintupled, as compared to the prior art.

The fiber product in accordance with the invention can be used, for example, for decorating panels, thermal insulators, sound insulators, wind protection panels, fire protection panels, replacing expanded polystyrene, packaging sheets, wet area panels, products which are pressed to shape, folding boxboards and their interiors, replacing the fluting of corrugated fiberboards, or similar purposes. The fiber product in accordance with the invention and products processed further therefrom can be used, for example, in wall and ceiling panels or the like for boarding the interiors. The fiber product can also be used to replace insulating structures, such as glass wool, etc. A desired design can be arranged on the panel surface, or the panel surface can be treated, laminated, or protected as desired, depending on the application.

The invention provides a light, hard and durable product. The invention also provides a product which is clearly lighter and has a clearly harder structure than the cardboard and paperboard products of the prior art. The product is easy to install in the desired destination, for example on a wall, and due to its lightness, also simple fastening means can be used. Therefore thicker materials, for example wall panels, can be produced.

The invention has the advantage of providing the fiber product with better thermal and sound insulation. Furthermore, the fiber product in accordance with the invention is easily moldable.

The invention also provides a porous, ecological, and recyclable product, supporting thus the principles of sustainable development.

DETAILED DESCRIPTION OF THE INVENTION

In the following section, the invention will be described by means of detailed examples of its embodiments.

Example 1

In this test, a fiber pulp with the desired degree of solidity was formed, to which fiber pulp basic sodium carbonate in powder form was added in the first step. In the second step, acetic acid in liquid form was added to the fiber pulp as the acidic component during the web formation. The acid, when added to the basic pulp, produced heavy gas formation in the pulp, thereby making the fiber pulp in the web lighter. The web was dried by heating and cut into sheets. This provided a fiber product with increased bulk and reduced density. The increase of bulk was fivefold.

Example 2

In this test, a fiber pulp was formed of wood fibers. Calcium carbonate was used as the basic component and acetic acid as the acidic component.

First, a fiber pulp was formed, which fiber pulp was dehydrated by boiling mechanically such that the water content of the pulp settled at about 50-60%. After this, the basic component was evenly mixed in the fiber pulp. Next, the acidic component was evenly mixed in the pulp. The small-bubbled carbon dioxide which was formed from the reaction of the base and the acid bound to the wood fibers and increased the fiber pulp volume for up to 200%. The formed pulp was heated so that water would evaporate through boiling. Calcium acetate salts concentrated from water among the drying wood fibers. When the pulp was fully dry, it was still briefly heated to a temperature of about 150° C. This resulted in melting of the calcium acetate salts, and, as the pulp cooled, in resolidification of the salts. The solidified acetate completed the hardening of the fiber pulp structure and provided the pulp with high bulk.

The tests showed that a chemical reaction occurs in the process, resulting in the formation of small-bubbled carbon dioxide gas, which then binds to wood fibers, thereby increasing the fiber pulp volume. The reaction also results in the formation of salt which precipitates among the wood fibers, thereby hardening the structure. This process in accordance with the invention requires dehydration.

Furthermore, the tests showed that the hard-ness of the fiber pulp structure could be increased by dosing starch into the fiber pulp with the basic component. The test also showed that the fiber product could be whitened by using calcium carbonate.

The process in accordance with the invention is suitable, in different embodiments, for use in the manufacture of different fiber products with high bulk from different fiber pulps. The process in accordance with the invention can also be used in the formation of thick and massive structures.

The embodiments of the invention are not limited to the examples referred to above; instead they may vary within the scope of the accompanying claims.

The invention claimed is:

1. A process for increasing bulk of a fiber pulp comprising:

adding a carbonate compound and an acid to a fiber pulp in separate steps and mixing the carbonate compound and the acid evenly in the fiber pulp, thereby forming a salt and a gas in the fiber pulp;

removing water from the fiber pulp; and heating the fiber pulp to the melting point of the salt and cooling, thereby hardening the fiber pulp, wherein a gas is formed in the fiber pulp, and wherein the bulk of the fiber pulp is increased, and wherein the hardness of the fiber pulp is increased.

2. The process in accordance with claim 1, wherein the carbonate compound is selected from the group comprising sodium carbonate, sodium bicarbonate, and calcium carbonate.

3. The process in accordance with claim 1, wherein the acid is selected from the group comprising acetic acid and sulfuric acid.

4. The process in accordance with claim 1, wherein water is removed from the fiber pulp before adding the basic and acidic components.

5. The process in accordance with claim 1, wherein water is removed from the fiber pulp after the salt and gas formation.

6. The process in accordance with claim 5, wherein water is removed from the fiber pulp by means of heating or vaporizing.

7. The process in accordance with claim 5, wherein the fiber pulp is briefly heated to the melting point of the salt, and then cooled.

8. The process in accordance with claim 1, further comprising adding starch to the fiber pulp.

* * * * *